US005941340A

United States Patent [19]

Anderson

[11] Patent Number: 5,941,340

[45] Date of Patent: Aug. 24, 1999

[54] DEVICE FOR USE IN CLIMBING OR IN TRANSPORTING A MASS

[75] Inventor: Preston L. Anderson, Seneca, Pa.

[73] Assignee: Dalloz Safety, Inc., Reading, Pa.

[21] Appl. No.: 08/829,338

[22] Filed: Mar. 31, 1997

[51] Int. Cl.[6] ..... A47L 3/04

[52] U.S. Cl. ..... 182/8

[58] Field of Search ..... 182/3, 4, 5, 8, 182/71, 72, 191; 188/65.1, 65.2; 254/391, 407

[56] References Cited

U.S. PATENT DOCUMENTS

| | | | |
|---|---|---|---|
| 904,119 | 11/1908 | Downs | 191/53 |
| 2,553,438 | 8/1947 | Tupper . | |
| 2,616,609 | 11/1952 | Herod . | |
| 3,348,632 | 10/1967 | Swager . | |
| 3,523,591 | 8/1970 | Fountain . | |
| 3,885,647 | 5/1975 | Acosta . | |
| 3,908,791 | 9/1975 | Kleine et al. . | |
| 3,979,797 | 9/1976 | Stember . | |
| 4,059,871 | 11/1977 | Swager . | |
| 4,071,926 | 2/1978 | Sweet et al. . | |
| 4,085,818 | 4/1978 | Swager . | |
| 4,111,280 | 9/1978 | Devine et al. . | |
| 4,130,177 | 12/1978 | Pandolph . | |
| 4,193,475 | 3/1980 | Sweet et al. . | |
| 4,265,179 | 5/1981 | Tupper et al. . | |
| 4,269,284 | 5/1981 | Swager . | |
| 4,352,409 | 10/1982 | Fountain . | |
| 4,462,316 | 7/1984 | Tupper . | |
| 4,502,668 | 3/1985 | Dodge, Jr. . | |
| 4,521,000 | 6/1985 | Dodge, Jr. . | |
| 4,846,075 | 7/1989 | Tupper | 182/5 X |
| 5,238,084 | 8/1993 | Swager . | |
| 5,265,696 | 11/1993 | Casebolt . | |

FOREIGN PATENT DOCUMENTS

| | | |
|---|---|---|
| 77053/73 | 11/1974 | Australia . |
| 1 168 021 | 1/1986 | European Pat. Off. . |
| 1336836 | 7/1962 | France . |
| 1961757 | 6/1971 | Germany . |
| 24 56 116 | 6/1975 | Germany . |
| 26 26 425 | 12/1977 | Germany . |
| 593107 | 5/1959 | Italy . |
| 772 554 | 10/1980 | U.S.S.R. . |
| 660406 | 11/1951 | United Kingdom . |
| 94/04786 | 3/1994 | WIPO . |

*Primary Examiner*—Daniel P. Stodola
*Assistant Examiner*—Richard M. Smith
*Attorney, Agent, or Firm*—Bartony Hare & Edson

[57] ABSTRACT

A device for use with a climbing or scaling apparatus comprises generally a first elongated rail member and a second elongated rail member. The device further comprises a gate mechanism. The gate mechanism maintains a spaced connection between the first rail member and the second rail member, while allowing the rungs to pass between the first rail member and the second rail member.

33 Claims, 7 Drawing Sheets

DEVICE FOR USE IN CLIMBING OR IN TRANSPORTING A MASS

FIELD OF THE INVENTION

The present invention is related to a device for use in climbing or in transporting a mass and, particularly, to such a device for use with climbing or scaling devices comprising spaced rungs.

BACKGROUND OF THE INVENTION

In countless number of activities at work and at home, people are required to climb ladders. Many accidents occur each year as a result of falls from ladders. Although a number of attempts have been made to develop devices to prevent injuries resulting from these accidents, such devices have met with only limited success. Most such devices operate by anchoring the user to the one or both of the side rails of the ladder. Typically, each such device is manufactured for use with a particular ladder design and cannot be used with other ladder designs without extensive modification. Given the wide variety of ladder designs, the use of such devices is extremely limited.

It is, therefore, very desirable to develop a device for use in transporting a load or in climbing that can be used with substantially any ladder design.

SUMMARY OF THE INVENTION

The present invention provides a device for use with a climbing or scaling apparatus. As used herein, the terms "scaling apparatus," "climbing apparatus" or "ladder" refer to any device comprising spaced rungs. Typically, such rungs are oriented parallel to each other and are evenly spaced. The device of the present invention comprises generally a first elongated rail member and a second elongated rail member. The device further comprises a gate mechanism. The gate mechanism maintains a spaced connection between the first rail member and the second rail member, while allowing the rungs to pass between the first rail member and the second rail member.

Preferably, the gate mechanism comprises at least two moveable projecting members. In general, each projecting member is preferably movably attached to one of the first elongated rail member and the second elongated rail member. Each projecting member is also preferably adapted to releasably connect to the other of the first elongated rail member and the second elongated rail member to maintain the first elongated rail member and the second elongated rail member in spaced connection. Each projecting member is moveable to disconnect or release from connection between the first rail member and the second rail member upon contact of the projecting member by a rung to allow the rung to pass thereby between the first elongated rail member and the second elongated rail member.

At least one of the projecting members preferably maintains a spaced connection between the first rail member and the second rail member at all times, however. More preferably, the gate mechanism comprises at least three projecting members and at least two of those projecting members, which are positioned at different longitudinal positions along the length of the elongated rail members, are releasably connected between the first elongated rail member and the second elongated rail member at any one time.

In one embodiment, two or more projecting members are preferably rotatably attached to one of the first elongated rail member and the second elongated rail member about a common axis of rotation. The projecting members are preferably radially positioned about the axis such that when one of the projecting members is displaced by a rung and caused to disconnect from connection between the first elongated rail member and the second elongated rail member, a second of the projecting members rotates into connection between the first elongated rail member and the second elongated rail member. Preferably, the second projecting member connects before the first projecting member disconnects.

In another embodiment, the gate mechanism comprises at least one wheel member. The wheel member is rotatably attached to one of the first elongated rail member and the second elongated rail member. The wheel member comprises recesses therein to define projecting members or wheel projections therebetween. Preferably, several recesses are spaced around the circumference of the wheel member to define several projecting members therebetween. Such recesses (and thereby, the projecting members) are preferably evenly spaced around the circumference of the wheel member. Preferably, the projecting members of the wheel member are spaced such that at least one of the projecting members of the wheel member is in releasable connection with the elongated rail member other than the elongated rail member to which the wheel member is rotatably attached regardless of the rotational position of the wheel member.

In general, each of the projecting members or wheel projections of the device preferably comprises an attachment member. The elongated rail member other than the elongated rail member to which the projecting member is movably (for example, rotatably) attached has connected thereto a cooperating attachment member. The attachment member of each projecting member cooperates with the cooperating attachment member to form a releasable connection between the first elongated rail member and the second elongated rail member. This releasable connection allows movement of the projecting member to disconnect from connection between the elongated rail members upon contact of the projecting member by a rung to allow the rung to pass thereby. The attachment members of the projecting members and the cooperating attachment member preferably comprise male and female cooperating attachment members. The attachment members of the projecting members and the cooperating attachment members preferably comprise arcuate male attachment members such as arcuate flanges and arcuate female attachment members such as arcuate grooves. The choice of placement of the male attachment member (that is, as the attachment member of the projecting member or the cooperating attachment member) is unimportant.

The gate mechanism may comprises a return mechanism to return a projecting member into releasable connection between the first elongated rail member and the second elongated rail member after the passing of a rung causes release of that projecting member from connection between the first elongated rail member and the second elongated rail member. The return mechanism may comprise, for example, a biasing mechanism such as a torsion spring.

A separate return mechanism is generally not required in the case of a wheel member comprising several projecting members spaced such that at least one of the projecting members of the wheel member is in releasable connection between the elongated rail members regardless of the rotational position of the wheel member. In that embodiment, the rotation of the wheel member during passing of a rung will always bring a projecting member adjacent the projecting member contacted by the rung into releasable connection between the elongated rail members.

The device also preferably comprises a load connection member attached to one of the first elongated rail member and the second elongated rail member. Any type of load can be attached to the load connection member. In a preferred embodiment the load connection member is adapted for attachment of a human user thereto.

The device preferably further comprises a braking device to stop downward movement of the device when the device exceeds a predetermined downward acceleration. The braking device preferably substantially prevents movement of at least one projecting member, thereby preventing rungs from passing that projecting member.

DETAILED DESCRIPTION OF THE INVENTION

Figure 1A:
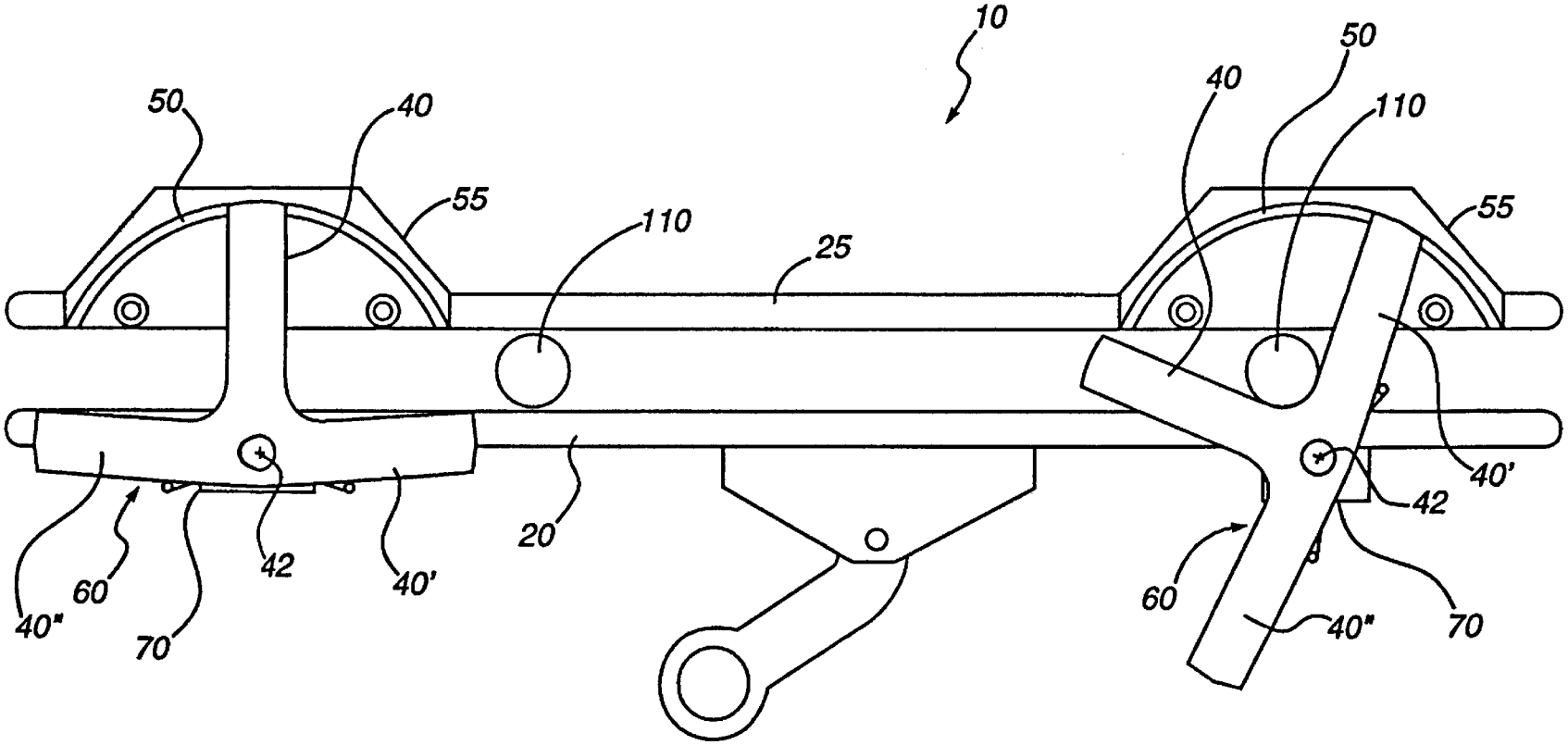
FIG. 1A illustrates a side view of one embodiment of a climbing device of the present invention.

The present invention provides a device to connect substantially any mass or load (for example, a human user) to any climbing or scaling apparatus comprising spaced rungs to raise or lower that load safely and effectively. In that regard, the device of the present invention assists in minimizing damage or injuries arising from falls from the climbing apparatus. FIG. 1A illustrates a side view of one embodiment of a device 10 of the present invention slideably disposed upon rungs 110 of a ladder. Only rungs 110 of the ladder and not the side rails thereof are shown.

As illustrated in FIG. 1A, device 10 comprises a first or front rail member 20 and a second or back rail member 25 that slide up and down the front and back, respectively, of rungs 110 during use of device 10. As used herein, the terms "front" or "forward" refer to a direction toward or closer to the user of device 10. The terms "back" or "rear" refer to a direction away from the user. Rail members 20 and 25 preferably have a length of at least slightly more than twice the spacing between rungs 110 to assist in maintaining device 10 attached to the ladder. In that regard, if the length of rail members 20 and 25 is less than twice the spacing between rungs 110, device 10, when located such that one of rungs 110 is at the center point of rail members 20 and 25, will be free to rotate around the axis defined by rung 110 and could possibly disengage from the ladder. Rail members 20 and 25 are preferably maintained generally perpendicular to the orientation of rungs 110 during use of device 10 to assist in smooth operation thereof. Rail members 20 and 25 are also preferably generally aligned to be coextensive and generally parallel to each other. Moreover, the width of the space between rail members 20 and 25 is preferably maintained generally constant.

Device 10 also comprises a gate mechanism that maintains a spaced connection between front rail member 20 and rear rail member 25 while allowing rungs 110 to pass between front rail member 20 and rear rail member 25 when the user of device 10 ascends or descends the ladder. In the embodiment of FIG. 1A, the gate mechanism comprises at least two projecting members 40 positioned at different longitudinal positions along the length of rail members 20 and 25. Projecting members 40 are movable when contacted by a rung 110 to allow rung 110 to pass thereby between first rail member 20 and second rail member 25.

Figure 1C:
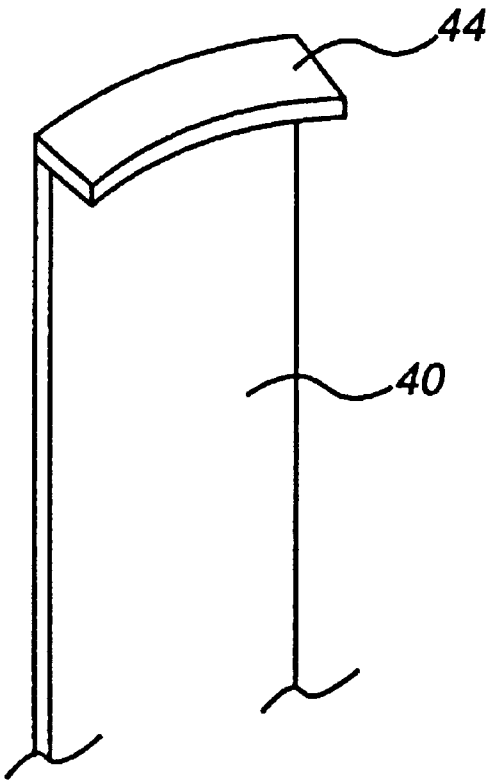
FIG. 1C illustrates a perspective view of a projecting member of FIG. 1A.
Figure 1B:
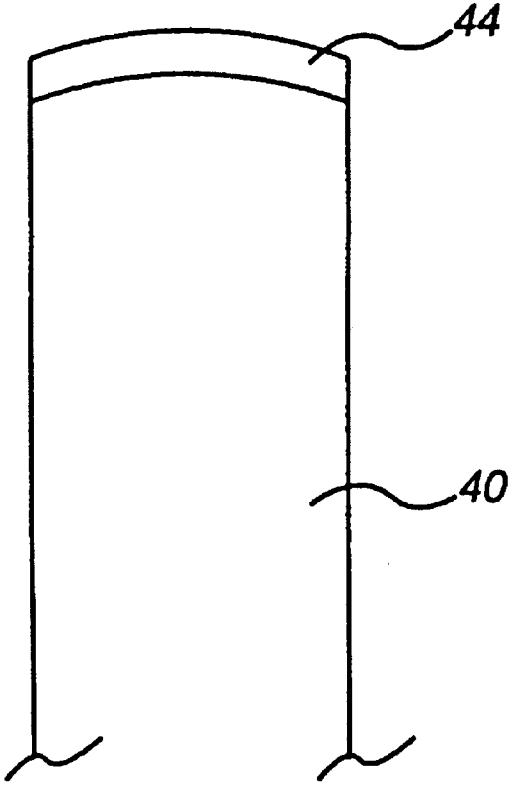
FIG. 1B illustrates a side view of a projecting member of FIG. 1A.

Each projecting member 40 is attached to one of first rail member 20 and second rail member 25 and is adapted to form a releasable attachment with the other of first rail member 20 and second rail member 25. In the illustrated embodiment, each projecting member 40 is rotatably attached to first rail member 20 about an axis 42 and comprises an arcuate flange 44 (see FIGS. 1B and 1C) on a distal end thereof which cooperates with an arcuate groove 50 formed on a track block 55 attached to second rail member 25.

To assist in ensuring that first rail member 20 and second rail member 25 remain in generally parallel, spaced connection, at least two projecting members 40 positioned at different longitudinal positions over the length of rail members 20 and 25 are preferably maintained in connection between rail members 20 and 25 at any instant. This result may be accomplished, for example, by providing at least three projecting members 40 positioned at three different longitudinal positions, such that two of those projecting members 40 may be maintained in connection between rail members 20 and 25 at any instant in time.

Alternatively, and as illustrated in FIG. 1A, the gate mechanism preferably comprises one or more multi-projection connectors 60. Each connector 60 comprises at least two projecting members 40 and 40' which are rotatable around a common axis 65. More preferably, at least three projecting members 40, 40' and 40" are provided. Preferably, at least two connectors 60 are provided at different longitudinal positions. Preferably, at least one of projecting members 40, 40' and 40" of each connector 60 is maintained in releasable attachment between rail members 20 and 25 (via arcuate flanges 44 and arcuate grooves 50) at all times. As illustrated in FIG. 1A, when a rung 110 contacts projecting member 40 during ascending or descending motion, projecting member 40 rotates about axis 42 with arcuate flange 45 of projecting member 40 passing through groove 50 to allow rung 110 to pass thereby. Preferably, second projecting member 40' or third projecting member 40" (depending upon the direction of movement of device 10), is caused to rotate such that the arcuate flange 44 thereof rotates into groove 50 to maintain the spaced connection between first rail 20 and second rail 25. In general, the separation between adjacent edges of arcuate flanges 44 of adjacent projecting members is less than approximately 90°. In this manner, a space connection between first rail member 20 and second rail member 25 can be maintained at all times at each connector 60.

Preferably, some mechanism is provided for ensuring that the projecting member(s) at any longitudinal position do not permanently rotate out of connection between rail members 20 and 25. Preferably, device 10 comprises a return mechanism 70 to return the projecting members to a desired connected position. In the embodiment illustrated in FIG. 1A, connectors 60 are preferably torsionally biased via return mechanism 70 to return projecting member 40 into releasable connection with second rail member 25. When projecting member 40 is in releasable connection between rail members 20 and 25, one of projecting member 40' and projecting member 40" will always be rotated into releasable connection with second rail member 25 when a rung 110 contacts projection member 40. After rung 110 passes the distal end of projecting member 40, return mechanism 70 preferably returns projecting member 40 into releasable connection with second rail member 25.

Figure 2:
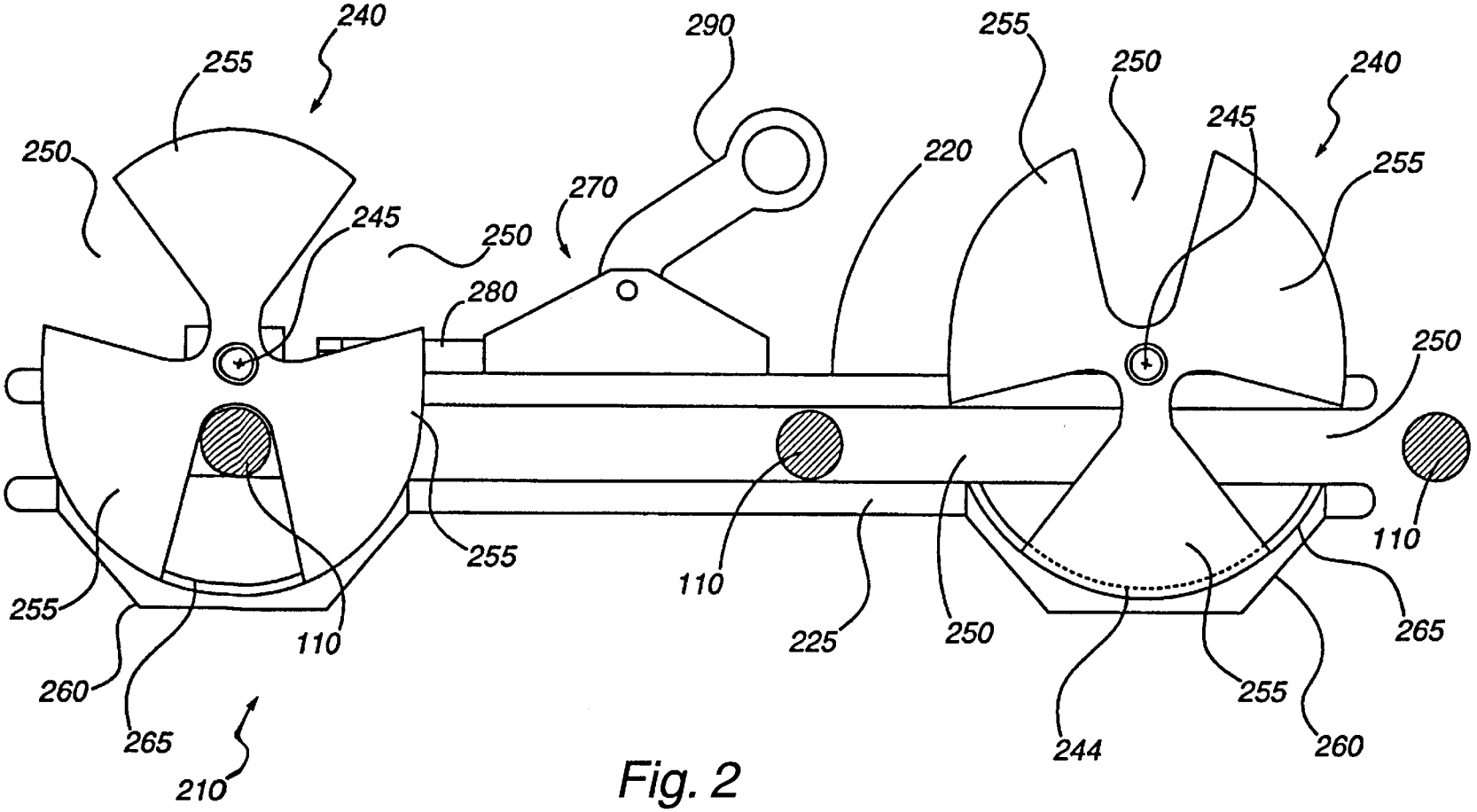
FIG. 2 illustrates a side view of another embodiment of a climbing device of the present invention.
Figure 3:
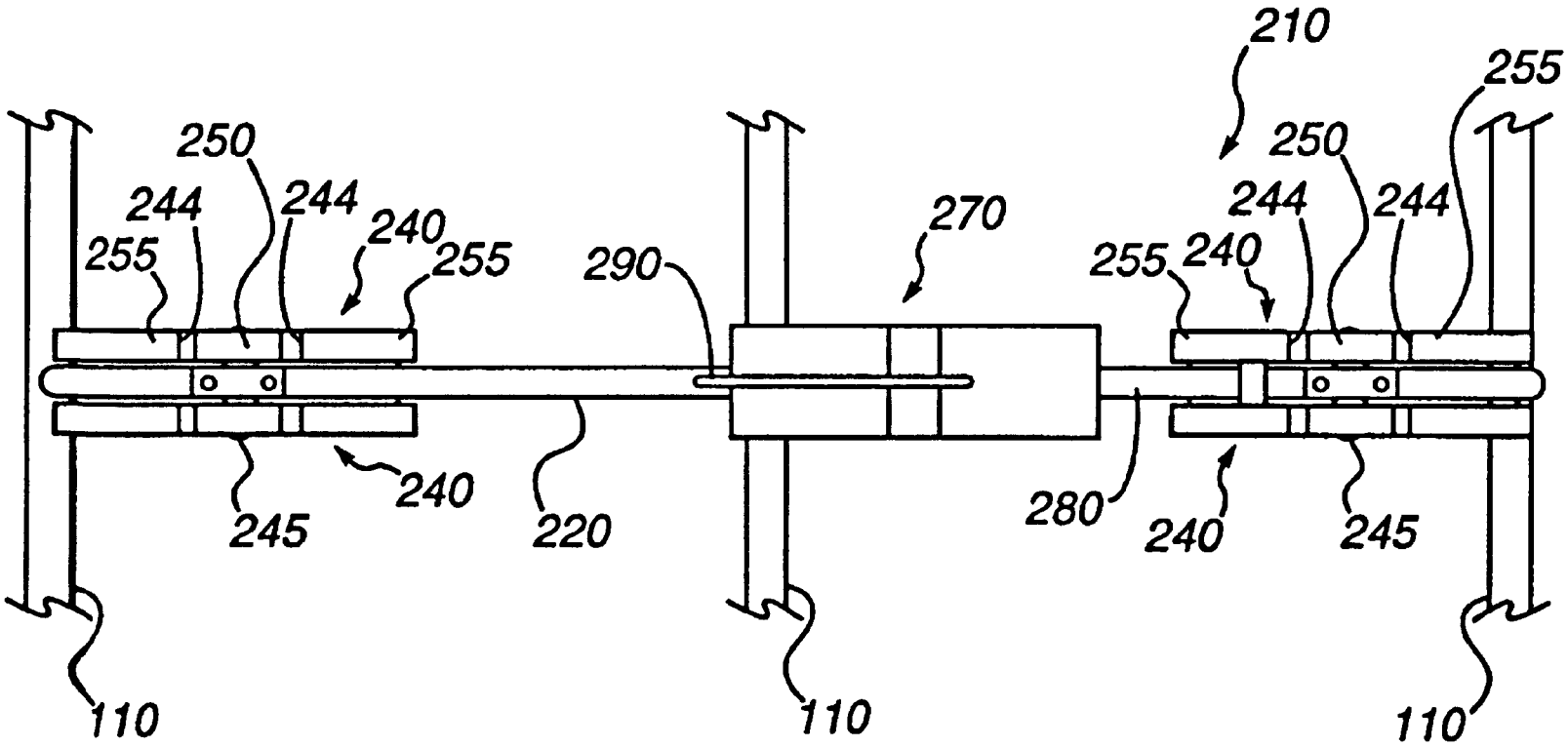
FIG. 3 illustrates a plan view of the embodiment of FIG. 2.

An alternative embodiment is illustrated in FIGS. 2 and 3. In this embodiment, the gate mechanism of a device 210 preferably comprises at least one wheel 240 mounted upon an axle 245 on one of first rail member 220 and second rail member 225. Each wheel 240 of device 210 preferably comprises several recesses or cutout portions 250 spaced around the circumference or perimeter of wheel 240. Preferably, recesses 250 are spaced substantially evenly around the circumference of wheel 240. In the illustrated embodiment there are three recesses 250 spaced equally (that is, at 120° intervals) around the circumference of wheel 240, thereby forming a "star wheel" 240 comprising three evenly spaced projecting members or wheel projections 255 as defined by recesses 250.

Preferably, a wheel 240 is connected to both ends of axle 245 on each side of front rail member 220 such that wheel projections 255 of opposing wheels 240 are kept in general alignment with each other even when wheels 240 are rotated about axle 245 (see FIG. 3). As clear to one skilled in the art, however, one wheel 240 per axle 245 is sufficient. Essentially any number of wheels or wheel pairs or sets may be positioned along the length of rail members 220 and 225. As illustrated in FIGS. 2 and 3, preferably two longitudinally spaced wheel sets are used. Any wheel set may be connected to another wheel set or sets by some mechanism (for example, by chain, belt, gears etc.), but the wheel sets are not required to be connected.

Wheel projections 255 of wheel(s) 240, when axle 245 is attached to first rail member 220, preferably form a releasable connection with second rail member 225 to maintain a spaced connection between first rail member 220 and second rail member 225 and thereby maintain device 210 slideably connected to or disposed upon rungs 110. Such connection preferably allows wheels 240 to rotate while maintaining first rail member 220 and second rail member 225 in spaced connection. In that regard, each wheel projection 255 preferably comprises an inwardly extending arcuate flange or lip 244 at its distal end or perimeter that is coaxial with the center of rotation of wheel 240. Second rail member 225 preferably comprises track blocks 260 attached thereto with which arcuate flanges 244 interact to form a connection between wheels 240 and track blocks 260. The number of track blocks 260 preferably corresponds to the number of wheels 240 or wheel sets on first rail member 220.

Each track block 260 preferably comprises an arcuate groove, track or channel 265 formed thereon. In the case that wheel sets are used, such grooves 265 are preferably formed on both sides of track block 265 to be in general alignment with each other. Arcuate grooves 265 preferably have substantially the same radius of curvature as arcuate flanges 244 and are preferably slightly wider than arcuate flanges 244 such that arcuate flanges 244 are accepted in and rotatably slide through arcuate grooves 265 as wheels 240 are rotated about axis 245. Individual track blocks 260 are preferably spaced along the length of second rail member 225 such that the center of rotation of arcuate groove 265 and the center of corresponding wheel axle 245 are substantially the same. The location of arcuate groove 265 in relation to second rail member 225 determines the distance between first rail member 220 and second rail member 225 and subsequently the size of rung 110 that device 210 can accept.

The arc length of arcuate groves 265 and the position of adjacent arcuate flanges 244 is preferably such that when arcuate flanges 244 engage grooves 265 from either side of track block 260, track block 260 (and thereby second rail member 225) remain in spaced connection to first rail member 220 via one of wheel projections 255 regardless of the rotational position of wheels 240. In general, the arc length of the separation between the adjacent distal edges of adjacent arcuate flanges 244 is preferably less than the arc length of arcuate grooves 265. More preferably, the arc length of the separation between the adjacent distal edges of adjacent arcuate flanges 244 is less than approximately one-half of the arc length of arcuate grooves 265.

As the user ascends or descends the ladder, projections 255 of wheels 240 contact rungs 110 causing wheels 240 to rotate. Rungs 110 pass by the longitudinal position of wheels 240 via one of recesses 250 as wheels 240 are caused to rotate by contact of rungs 110 with wheel projections 255. The connection of wheels 240 to track blocks 260 maintains the spaced connection of first rail member 220 and second rail member 240 as rungs 110 pass. In this manner, device 210 can move along the length of the ladder without hindrance from rungs 110 and without disconnection from the ladder. As illustrated in FIG. 2, recesses 250 are preferably wider at the perimeter of wheel 240 than towards the center thereof to allow for slight misalignment of wheel 240 when it engages a ladder rung 110. This design also facilitates engagement of a rung 110 if it is approaching from the top or bottom of the wheel 240 (that is, upon ascending or descending movement of the user). The width of recesses 250 is preferably equal to or greater than the distance between first rail member 220 and second rail member 225 so that recesses 250 may accommodate the largest possible rung size that may pass through device 210. As clear to one skilled in the art, the devices of the present invention can be used with substantially any ladder design.

Figure 4A:
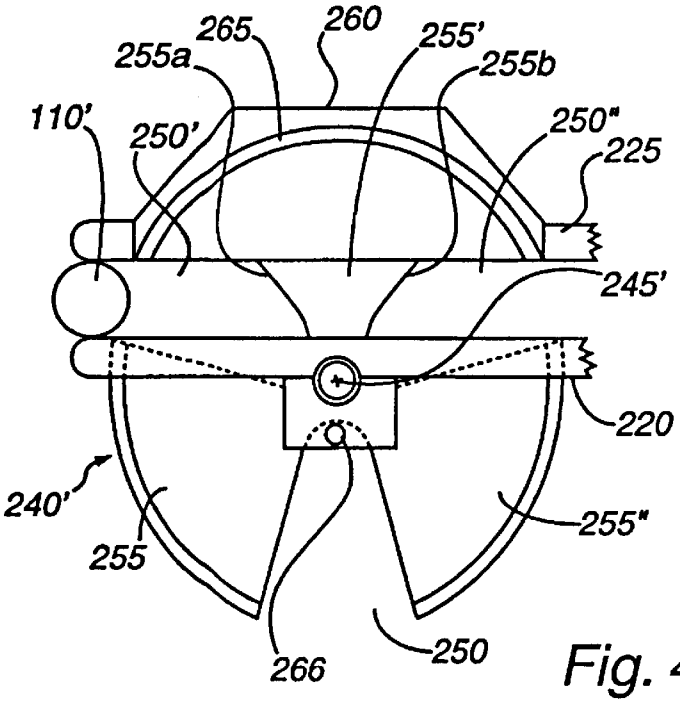
FIG. 4A illustrates a side view of an embodiment of a climbing device comprising a detent mechanism for assisting in properly positioning the wheel projections of the wheel member of the climbing device in which the detent mechanism is in the engagement or rest position.
Figure 4C:
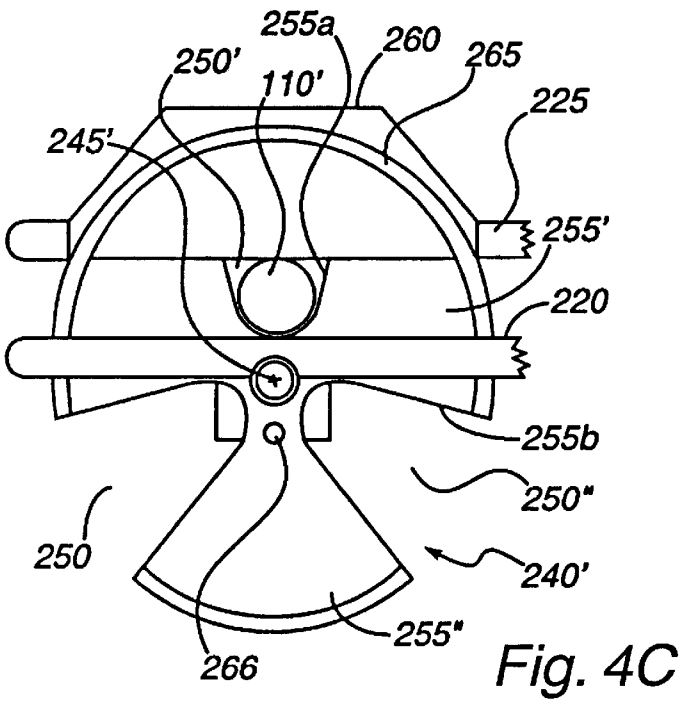
FIG. 4C illustrates a side view of the climbing device of FIG. 4A in which the detent mechanism is in the disengagement position during rotation of the wheel member by a rung.
Figure 4B:
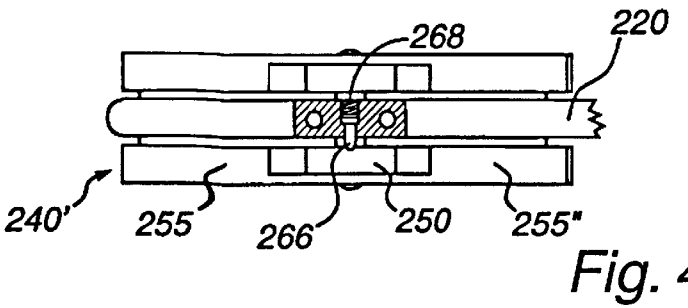
FIG. 4B illustrates a top view of the climbing device of FIG. 4A showing the detent mechanism in the engagement position.
Figure 4D:
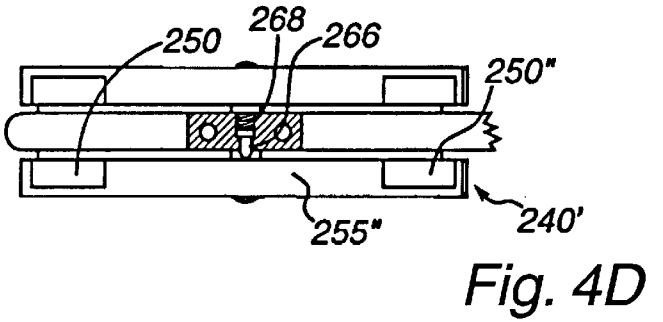
FIG. 4D illustrates a top view of the climbing device of FIG. 4A showing the detent mechanism in the disengagement position.

Device 210 preferably also comprises an alignment mechanism to assist in properly aligning recesses 250 of each wheel 240 to accept a rung 110 during ascending or descending motion by the user of device 210. In that regard, if one of wheel projections 255 of a wheel 240 comes to rest between first rail member 220 and second rail member 225 (that is, blocking the space between first rail member 220 and second rail member 225) after a rung 110 passes by wheel 240, another rung 110 will contact the blocking wheel projection and be prevented from passing by of wheel 240. Movement of the user will thereby be stopped. As illustrated, for example, in FIG. 4A, a first recess 250' is preferably aligned with the gap between rail members 220 and 225 on one side of wheel 240 and a second recess 250"

is preferably aligned with the gap between rail member 220 and 225 on the other side of wheel 240. Preferably, no portion of the perimeter of any wheel projection extends into the space between rail members 220 and 225. In this manner, a rung 110 can only contact wheel projections 255' on one of sides 255*a* or 255*b* thereof as defined by recesses 250' and 250", respectively.

In the embodiment illustrated in FIGS. 4A through 4D, the alignment mechanism comprises a detent mechanism including a detent member 266. Detent member 266 is preferably loaded by a spring 268 to be biased into contact with wheel 240'. Recesses 250' and 250" are automatically rotated into the desired position illustrated in FIG. 4A when rung 110' exits recess 250', but may rotate out of the desired position if wheel 240' is allowed to rotate freely. Detent member 266 is preferably located such that it is biased by spring 268 to be forced into the recess 250 of wheel 240' approximately at the bottom of recess 250 (that is, approximately at the point of recess 250 radially closest to the axis of rotation 245' of wheel 240'. Detent member 266 will thus tend to stop the rotation of wheel 240' in the desired position illustrated in FIG. 4A.

When wheel 240' is later caused to rotate by contact with rung 110' or another rung with wheel projection 255' during ascending or descending motion of the user, one of wheel projections 255 or 255" will contact detent member 266 and force detent member 266 away from wheel 240' to allow wheel 240' to rotate. In that regard, the distal end of detent member 266, which contacts wheel 240', is preferably rounded to facilitate rotation of wheel 240'. If the user moves, for example, such that rung 110' contacts surface 255*a* of wheel projection 255', wheel 240' will be rotated clockwise so that wheel projection 255' contacts detent member 266, forcing detent member 266 away from wheel 240' to allow wheel 240' to rotate about axis 245' (see FIGS. 4C and 4D). As rung 110' passes axis 245' of wheel 240', recesses 250' and 250 will be rotated into position to be aligned with the gap between rail members 220 and 225. Detent member 266 will be biased into recess 250" to prevent further rotation of wheel 240'. Preferably, the biasing force upon detent member 266 is sufficient to prevent undesirable rotation of wheel 240' after passing of a rung 110 but not enough to hinder the motion of the user.

In the embodiments illustrated in FIGS. 1A and 2, axle 42 of each connector 60 and axle 245 of each wheel 240 is shown to be connected to first rail member 20 and 220, respectively. Correspondingly, each tracking block 60 or 260 is connected to second rail member 25 or 225. As clear to one skilled in the art, however, all connectors 60 or wheels 240 need not be connected to the same rail member in any single device of the present invention. In that regard, each connector 60 or wheel 240 is connected to one of the rail members, and a corresponding track block 60 or 260 is connected the other of the rail members.

Devices 10 or 210 also preferably comprises an attachment assembly 270 and a braking mechanism 280. Attachment assembly 270 is preferably attached to first rail 220 and preferably provides a housing for braking mechanism 280 and a rotatable connection for a connection lever 290. Connection lever 290 provides for connection between device 210 and a load such as a human user. A human user preferably wears an industrial safety belt or harness which is preferably specifically designed to be used with device 210.

Figure 5:
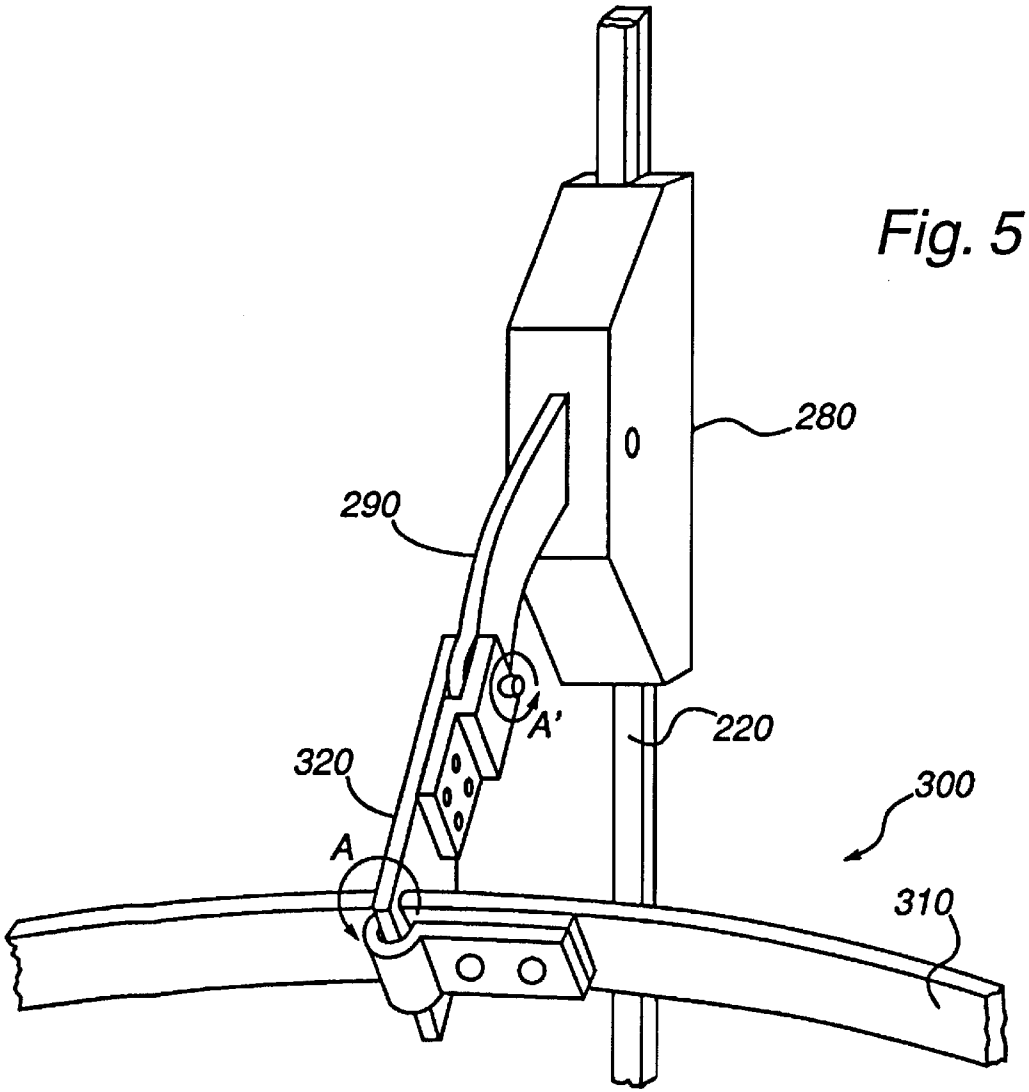
FIG. 5 illustrates a perspective view of a connection mechanism for connecting to a load (for example, a human user).

An embodiment of such a belt 300 is illustrated in FIG. 5. In this embodiment, belt 300 comprises a belt member 310 such as a safety strap to wrap around the user. Belt member 310 is preferably rotatably attached to a connection member 320. Belt member 310 is preferably rotatable in at least one plane for each position of connection member 320 as described for one position of connection member 320 by arrow A in FIG. 5. Connection member 320 is preferably rotatably and removably attached to connection lever 290 to be rotatable only in a plane described by arrow A'. The plane of rotation of connection member 320 preferably includes first and second rail member 220 and 225, respectively, therein. Allowing connecting member 320 to rotate only in plane with first rail members 220 and second rail member 225 assists in preventing rotation of device 210 out of a position substantially perpendicular to the orientation of rungs 110. Belt member 310, however, is preferably free to move in numerous planes to increase the freedom of movement of the user.

Connection lever 290 preferably allows freedom of movement both in the ascending and descending direction along the length of the ladder, but engages/activates braking mechanism 280 in the event of a slip or fall. For example, if device 210 exceeds a predetermined downward acceleration or force corresponding to a fall, braking mechanism 280 can be activated to stop one or more of wheels 240 from rotating in the descending direction, effectively locking device 210 and the user to the next rung 110 that is encountered by device 210 in descending.

Figure 6B:
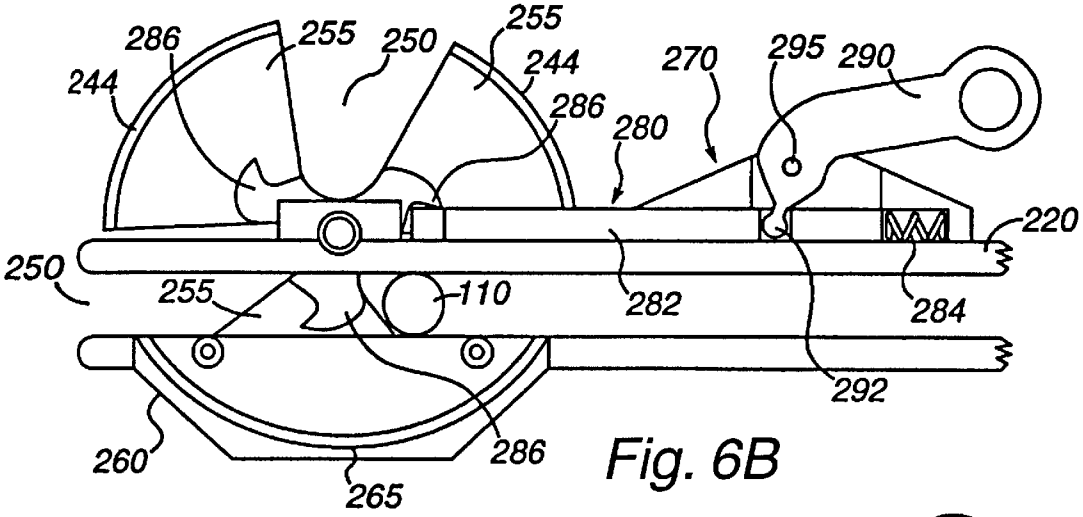
FIG. 6B illustrates a side view of an embodiment of the present invention in which a braking mechanism is engaged.
Figure 6A:
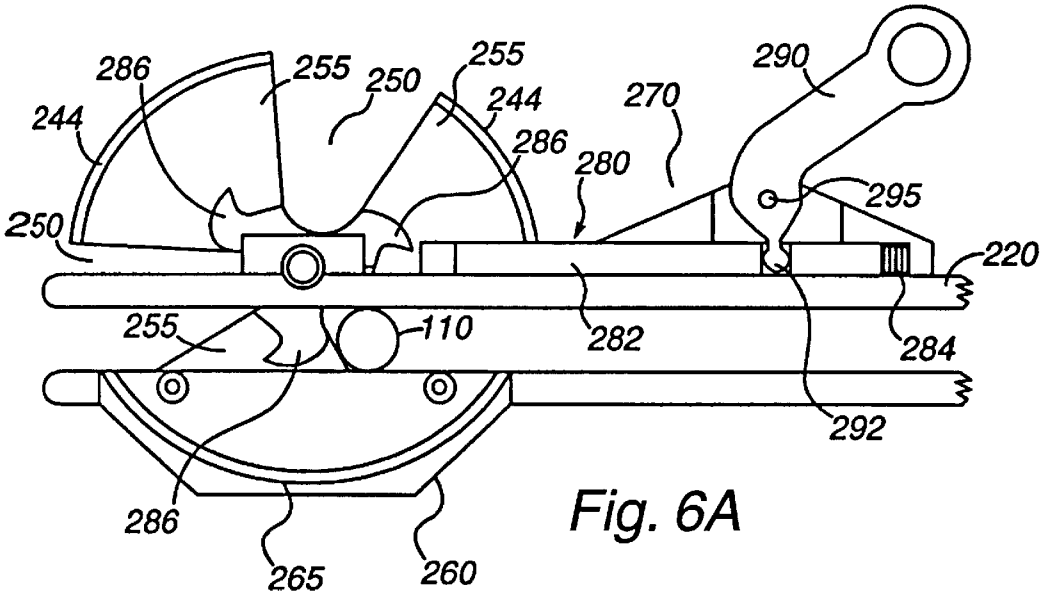
FIG. 6A illustrates a side view of an embodiment of the present invention in which a braking mechanism is disengaged.

FIGS. 6A and 6B illustrate one embodiment of a braking mechanism 280 for use with device 210. In this embodiment, braking mechanism 280 comprises an abutment member 282 in operative connection with connection lever 290. Abutment member 282 is preferably also in connection with a biasing or loading mechanism such as spring 284 that provides a force tending to bias abutment member 282 into an engagement position as illustrated in FIG. 5B. At least one of wheel projections 255 is preferably provided with a stop member such as a tooth 286 that cooperates with abutment member 282 to stop rotation of wheel 240 in a fall situation, thereby locking device 210 at a particular position on the ladder.

Connection lever 290 is preferably rotatable in plane with rail members 220 and 225 about an axis 295. Abutment member 282 is preferably in operative connection with connection lever 290 (via, for example, projection 292) such that when connection lever 290 is in a first or up position (illustrated in FIG. 5A) abutment member 282 is disengaged from tooth 286. Connection lever 290 is preferably in the first position when attached to a user and the user is climbing, stationary or in a controlled decent. In that regard, connection lever 290 is preferably positioned above the center of gravity of device 210. The weight of device 210 will thus tend to keep connection lever 290 in the first position when attached to the user under the conditions described above. Positioning connection lever 290 above the center of gravity of device 210 also assists in preventing rotation of rail members 220 and 225 out of a plane generally perpendicular to the orientation of rungs 110.

If, however, the user begins to fall (that is, if the user experiences a descending acceleration greater than a predetermined safe descending acceleration), connection lever 290 will be forced into a second or down position as illustrated in FIG. 5B, thereby forcing abutment member 282 into contact with tooth 286 and preventing further decent of device 210 and the user.

Although the present invention has been described in detail in connection with the above examples, it is to be understood that such detail is solely for that purpose and that variations can be made by those skilled in the art without departing from the spirit of the invention except as it may be limited by the following claims.

What is claimed is:

1. A device for use with a scaling apparatus, the scaling apparatus comprising at least three consecutively spaced rungs, the device comprising:

a. a first elongated rail member;

b. a second elongated rail member, each of the first elongated rail member and the second elongated rail member having a length capable of simultaneously contacting the first and third rungs;

c. a gate mechanism, the gate mechanism maintaining a spaced connection between the first elongated rail member and the second elongated rail member, the gate mechanism comprising at least a first projecting member and a second projecting member, the first projecting member being adapted to extend across the space between the first elongated rail member and the second elongated rail member to releasably connect the first elongated rail member and the second rail member in spaced connection, the second projecting member being adapted to extend between the first elongated rail member and the second elongated rail member to releasably connect the first elongated rail member and the second elongated rail member in spaced connection, each of the first projecting member and the second projecting member being movable upon contact with a rung during movement of the device to disconnect from connection between the first elongated rail member and the second elongated rail member to allow one of the rungs to pass thereby between the first elongated rail member and the second elongated rail member, at least one of the first projecting member and the second projecting member being in releasable connection between the first elongated rail member and the second elongated rail member at all times;

d. a load connection member attached to one of the first elongated rail member and the second elongated rail member.

2. The device of claim 1 wherein the first projecting member is rotatably attached to one of the first elongated rail member and the second elongated rail member, the first projecting member comprising a first attachment member, the first attachment member cooperating with a first cooperating attachment member connected to the other of the first elongated rail member and the second elongated rail member to releasably connect the first elongated rail member to the second elongated rail member.

3. The device of claim 2 wherein the second projecting member is rotatably attached to one of the first elongated rail member and the second elongated rail member, the second projecting member comprising a second attachment member, the second attachment member cooperating with a second cooperating attachment member connected to the other of the first elongated rail member and the second elongated rail member to releasably connect the first elongated rail member to the second elongated rail member.

4. The device of claim 1 wherein the first projecting member and the second projecting member are rotatably attached to one of the first elongated rail member and the second elongated rail member about the same axis of rotation, the first projecting member comprising a first attachment member, the first attachment member adapted to cooperate with a first cooperating attachment member connected to the other of the first elongated rail member and the second elongated rail member to releasably connect the first elongated rail member to the second elongated rail member, the second projecting member comprising a second attachment member, the second attachment member adapted to cooperate with the first cooperating attachment member to releasably connect the first elongated rail member to the second elongated rail member.

5. The device of claim 4 wherein the first cooperating attachment member comprises a first arcuate groove, the first attachment member comprises a first arcuate flange and the second attachment member comprises a second arcuate flange.

6. The device of claim 4 wherein the gate mechanism comprises a third projecting member and a fourth projecting member, the third projecting member and the fourth projecting member being rotatably attached to one of the first elongated rail member and the second elongated rail member about the same axis of rotation, the axis of rotation of the third projecting member and the fourth projecting member being located at a longitudinal position different from the axis of rotation of the first projecting member and the second projecting member, the third projecting member comprising a third attachment member, the third attachment member being adapted to cooperate with a second cooperating attachment member connected to the other of the first elongated rail member and the second elongated rail member to releasably connect the first elongated rail member to the second elongated rail member, the fourth projecting member comprising a fourth attachment member, the fourth attachment member being adapted to cooperate with the second cooperating attachment member to releasably connect the first elongated rail member to the second elongated rail member.

7. The device of claim 6 wherein the first cooperating attachment member comprises a first arcuate groove and the second cooperating attachment member comprises a second arcuate groove, the first attachment member comprises a first arcuate flange and the second attachment member comprises a second arcuate flange, and the third attachment member comprises a third arcuate flange and the fourth attachment member comprises a fourth arcuate flange.

8. The device of claim 6 further comprising a first return mechanism to return at least one of the first attachment member and the second attachment member into releasable connection with the first cooperating attachment member, and a second return mechanism to return at least one of the third attachment member and the fourth attachment member into cooperating attachment with the second cooperating attachment member.

9. The device of claim 1 further comprising a braking device to stop movement of the device in a downward direction when the device reaches a predetermined downward acceleration.

10. The device of claim 9 wherein the braking device prevents movement of at least one of the first projecting member and the second projecting member, thereby preventing one of the rungs from passing thereby.

11. The device of claim 1 further comprising a return mechanism to return the first projecting member and the second projecting member into releasable contact between the first elongated rail member and the second elongated rail member after disconnection thereof upon contact with a rung.

12. A device for use with a scaling apparatus, the scaling apparatus comprising at least three consecutively spaced rungs, the device comprising:

a. a first elongated rail member;

b. a second elongated rail member, each of the first elongated rail member and the second elongated rail member having a length capable of simultaneously contacting the first and third rungs;

c. at least a first wheel member, the first wheel member being rotatably attached to one of the first elongated rail member and the second elongated rail member at a first longitudinal position; the first wheel member comprising at least three recesses around the circumference of the first wheel member, the recesses defining wheel projections therebetween, each of the wheel projections comprising an attachment member;

d. the other of the first elongated rail member and the second elongated rail member having connected thereto a first cooperating attachment member, the attachment member of each wheel projection of the first wheel member being adapted to cooperate with the first cooperating attachment member to form a releasable attachment with the first cooperating attachment member, thereby allowing rotation of the first wheel member relative to the first elongated rail member and the second elongated rail member while maintaining a spaced connection between the first elongated rail member and the second elongated rail member;

e. a load connection member attached to one of the first elongated rail member and the second elongated rail member.

13. The device of claim 12 further comprising:

f. a second wheel member, the second wheel member being rotatably attached to one of the first elongated rail member and the second elongated rail member at a second longitudinal position; the second wheel member comprising at least three recesses around the circumference of the second wheel member, the recesses defining wheel projections therebetween, each of the wheel projections comprising an attachment member, g. the other of the first elongated rail member and the second elongated rail member having connected thereto a second cooperating attachment member, the attachment member of each wheel projection of the second wheel member adapted to cooperate with the second cooperating attachment member to form a releasable attachment with the second cooperating member, thereby allowing rotation of the second wheel member relative to the first elongated rail member and the second elongated rail member while maintaining a spaced connection between the first elongated rail member and the second elongated rail member.

14. The device of claim 13 wherein at least one of the attachment members of the projecting members of the first wheel member is in releasable attachment with the first cooperating attachment member at any rotational position of the first wheel member, and at least one of the attachment members of the projecting members of the second wheel member is in releasable attachment with the second cooperating attachment member at any rotational position of the second wheel member.

15. The device of claim 14 further comprising a braking apparatus in operative connection with the wheel member, the braking apparatus comprising a stop mechanism to stop the wheel from rotating relative to the first elongated rail member and the second elongated rail member upon the device reaching a predetermined downward acceleration.

16. The device of claim 15 wherein each of the first wheel member and the second wheel member comprises three recesses, the recesses being substantially evenly spaced about the circumference of each the first wheel member and the second wheel member, the attachment member of each of the wheel projections comprising an arcuate flange, the first cooperating attachment member comprising an arcuate groove suitable to rotatably receive the arcuate flange of each of the wheel projections of the first wheel member, and the second cooperating attachment member comprising an arcuate groove suitable to rotatably receive each of the arcuate flanges of the wheel projections of the second wheel member.

17. The device of claim 16 further comprising a first alignment mechanism a second alignment mechanism, the first alignment mechanism comprising a first detent member adapted to stop rotation of the first wheel member in a position such that substantially no portion of a perimeter of any of the wheel projections of the first wheel member is in the space between the first rail member and the second rail member, the second alignment mechanism comprising a second detent member adapted to stop rotation of the second wheel member in a position such that substantially no portion of a perimeter of any of the wheel projections of the second wheel member is in the space between the first rail member and the second rail member.

18. The device of claim 12 further comprising an alignment mechanism, the alignment mechanism comprising a first detent member adapted to stop rotation of the first wheel member in a position such that substantially no portion of a perimeter of any of the wheel projections is in the space between the first rail member and the second rail member.

19. The device of claim 18 wherein the first detent member is biased to be forced into one of the recesses of the first wheel member to stop rotation thereof.

20. The device of claim 18 wherein the first detent member is biased to be forced into one of the recesses of the first wheel member to stop rotation thereof and a second detent member is biased to be forced into a recess of a second wheel member to stop rotation thereof.

21. The device of claim 12 further comprising a second wheel member rotatably attached to the one of the first elongated rail member and the second elongated rail member to which the first wheel member is attached, the first wheel member being rotatable about a first axis on a first side of the one of the first elongated rail member and the second elongated rail member, the first wheel member comprising three recesses spaced substantially evenly about the circumference of the first wheel member, the second wheel member being rotatable about the first axis on a second side of the one of the first elongated rail member and the second elongated rail member, the second wheel member comprising three recesses spaced substantially evenly around the circumference of the second wheel member, the recesses of the second wheel member defining wheel projections therebetween, each of the wheel projections of the second wheel member comprising an attachment member, the first wheel member and the second wheel member being adapted to rotate in substantial unison such that the recesses of the first wheel member and the recesses of the second wheel member remain in general alignment with each other, the other of the first elongated rail member and the second elongated rail member comprising a second cooperating attachment member, the attachment member of each wheel projection of the second wheel member being adapted to cooperate with the second cooperating attachment member to form a releasable attachment with the second cooperating attachment member, thereby allowing rotation of the second wheel member relative to the first elongated rail member and the second elongated rail member while maintaining a spaced connection between the first elongated rail member and the second elongated rail member.

22. A device for use with a scaling apparatus, the scaling apparatus comprising spaced rungs, the device comprising:

a. a first elongated rail member;

b. a second elongated rail member;

c. a gate mechanism, the gate mechanism maintaining a spaced connection between the first elongated rail member and the second elongated rail member, the gate mechanism comprising at least a first projecting member and a second projecting member, the first projecting member being adapted to extend across the space between the first elongated rail member and the second elongated rail member to releasably connect the first elongated rail member and the second rail member in spaced connection, the second projecting member being adapted to extend between the first elongated rail member and the second elongated rail member to releasably connect the first elongated rail member and the second elongated rail member in spaced connection, each of the first projecting member and the second projecting member being movable upon contact with a rung during movement of the device to disconnect from connection between the first elongated rail member and the second elongated rail member to allow one of the rungs to pass thereby between the first elongated rail member and the second elongated rail member, at least one of the first projecting member and the second projecting member being in releasable connection between the first elongated rail member and the second elongated rail member at all times; the first projecting member and the second projecting member being rotatably attached to one of the first elongated rail member and the second elongated rail member about the same axis of rotation, the first projecting member comprising a first attachment member, the first attachment member adapted to cooperate with a first cooperating attachment member connected to the other of the first elongated rail member and the second elongated rail member to releasably connect the first elongated rail member to the second elongated rail member, the second projecting member comprising a second attachment member, the second attachment member adapted to cooperate with the first cooperating attachment member to releasably connect the first elongated rail member to the second elongated rail member, the gate mechanism a third projecting member and a fourth projecting member, the third projecting member and the fourth projecting member being rotatably attached to one of the first elongated rail member and the second elongated rail member about the same axis of rotation, the axis of rotation of the third projecting member and the fourth projecting member being located at a longitudinal position different from the axis of rotation of the first projecting member and the second projecting member, the third projecting member comprising a third attachment member, the third attachment member being adapted to cooperate with a second cooperating attachment member connected to the other of the first elongated rail member and the second elongated rail member to releasably connect the first elongated rail member to the second elongated rail member, the fourth projecting member comprising a fourth attachment member, the fourth attachment member being adapted to cooperate with the second cooperating attachment member to releasably connect the first elongated rail member to the second elongated rail member;

d. a load connection member attached to one of the first elongated rail member and the second elongated rail member.

23. The device of claim 22 wherein the first cooperating attachment member comprises a first arcuate groove and the second cooperating attachment member comprises a second arcuate groove, the first attachment member comprises a first arcuate flange and the second attachment member comprises a second arcuate flange, and the third attachment member comprises a third arcuate flange and the fourth attachment member comprises a fourth arcuate flange.

24. The device of claim 22 further comprising a first return mechanism to return at least one of the first attachment member and the second attachment member into releasable connection with the first cooperating attachment member, and a second return mechanism to return at least one of the third attachment member and the fourth attachment member into cooperating attachment with the second cooperating attachment member.

25. A device for use with a scaling apparatus, the scaling apparatus comprising spaced rungs, the device comprising:

a. a first elongated rail member;

b. a second elongated rail member;

c. at least a first wheel member, the first wheel member being rotatably attached to one of the first elongated rail member and the second elongated rail member at a first longitudinal position; the first wheel member comprising at least three recesses around the circumference of the first wheel member, the recesses defining wheel projections therebetween, each of the wheel projections comprising an attachment member;

d. the other of the first elongated rail member and the second elongated rail member having connected thereto a first cooperating attachment member, the attachment member of each wheel projection of the first wheel member being adapted to cooperate with the first cooperating attachment member to form a releasable attachment with the first cooperating attachment member, thereby allowing rotation of the first wheel member relative to the first elongated rail member and the second elongated rail member while maintaining a spaced connection between the first elongated rail member and the second elongated rail member;

e. a load connection member attached to one of the first elongated rail member and the second elongated rail member; and f. a second wheel member, the second wheel member being rotatably attached to one of the first elongated rail member and the second elongated rail member at a second longitudinal position; the second wheel member comprising at least three recesses around the circumference of the second wheel member, the recesses defining wheel projections therebetween, each of the wheel projections comprising an attachment member, g. the other of the first elongated rail member and the second elongated rail member having connected thereto a second cooperating attachment member, the attachment member of each wheel projection of the second wheel member adapted to cooperate with the second cooperating attachment member to form a releasable attachment with the second cooperating member, thereby allowing rotation of the second wheel member relative to the first elongated rail member and the second elongated rail member while maintaining a spaced connection between the first elongated rail member and the second elongated rail member.

26. The device of claim 25 wherein at least one of the attachment members of the projecting members of the first wheel member is in releasable attachment with the first cooperating attachment member at any rotational position of the first wheel member, and at least one of the attachment members of the projecting members of the second wheel member is in releasable attachment with the second cooperating attachment member at any rotational position of the second wheel member.

27. The device of claim 26 further comprising a braking apparatus in operative connection with the wheel member, the braking apparatus comprising a stop mechanism to stop the wheel from rotating relative to the first elongated rail member and the second elongated rail member upon the device reaching a predetermined downward acceleration.

28. The device of claim 27 wherein each of the first wheel member and the second wheel member comprises three recesses, the recesses being substantially evenly spaced about the circumference of each the first wheel member and the second wheel member, the attachment member of each of the wheel projections comprising an arcuate flange, the first cooperating attachment member comprising an arcuate groove suitable to rotatably receive the arcuate flange of each of the wheel projections of the first wheel member, and the second cooperating attachment member comprising an arcuate groove suitable to rotatably receive each of the arcuate flanges of the wheel projections of the second wheel member.

29. The device of claim 28 further comprising a first alignment mechanism a second alignment mechanism, the first alignment mechanism comprising a first detent member adapted to stop rotation of the first wheel member in a position such that substantially no portion of a perimeter of any of the wheel projections of the first wheel member is in the space between the first rail member and the second rail member, the second alignment mechanism comprising a second detent member adapted to stop rotation of the second wheel member in a position such that substantially no portion of a perimeter of any of the wheel projections of the second wheel member is in the space between the first rail member and the second rail member.

30. The device of claim 25 further comprising an alignment mechanism, the alignment mechanism comprising a first detent member adapted to stop rotation of the first wheel member in a position such that substantially no portion of a perimeter of any of the wheel projections is in the space between the first rail member and the second rail member.

31. The device of claim 30 wherein the first detent member is biased to be forced into one of the recesses of the first wheel member to stop rotation thereof.

32. The device of claim 30 wherein the first detent member is biased to be forced into one of the recesses of the first wheel member to stop rotation thereof and a second detent member is biased to be forced into a recess of the second wheel member to stop rotation thereof.

33. The device of claim 25 further comprising a second wheel member rotatably attached to the one of the first elongated rail member and the second elongated rail member to which the first wheel member is attached, the first wheel member being rotatable about a first axis on a first side of the one of the first elongated rail member and the second elongated rail member, the first wheel member comprising three recesses spaced substantially evenly about the circumference of the first wheel member, the second wheel member being rotatably about the first axis on a second side of the one of the first elongated rail member and the second elongated rail member, the second wheel member comprising three recesses spaced substantially evenly around the circumference of the second wheel member, the recesses of the second wheel member defining wheel projections therebetween, each of the wheel projections of the second wheel member comprising an attachment member, the first wheel member and the second wheel member being adapted to rotate in substantial unison such that the recesses of the first wheel member and the recesses of the second wheel member remain in general alignment with each other, the other of the first elongated rail member and the second elongated rail member comprising a second cooperating attachment member, the attachment member of each wheel projection of the second wheel member being adapted to cooperate with the second cooperating attachment member to form a releasable attachment with the second cooperating attachment member, thereby allowing rotation of the second wheel member relative to the first elongated rail member and the second elongated rail member while maintaining a spaced connection between the first elongated rail member and the second elongated rail member.

* * * * *